US009982200B2

(12) United States Patent
Marve et al.

(10) Patent No.: US 9,982,200 B2
(45) Date of Patent: May 29, 2018

(54) METHOD FOR REMOVING CHLORIDES FROM HYDROCARBON STREAM BY STEAM STRIPPING

(71) Applicant: Reliance Industries Limited, Mumbai (IN)

(72) Inventors: Mahesh Gopalrao Marve, Maharashtra (IN); Amit Kumar Parekh, Gujarat (IN); Asit Kumar Das, Faridabad (IN); Rajeshwer Dongara, Gujarat (IN); Devpal Singh Rana, Bulandshahr (IN); Harender Bisht, Uttarakhand (IN); Hitesh Kumar Sahu, Chhattisgarh (IN); Jai Kumar Singh, Bagpat (IN); Kalyan Nath, Axom (IN); Manoj Yadav, Haryana (IN); Sampath Nerivetla, Andhra Pradesh (IN); Sukumar Mandal, Maharashtra (IN)

(73) Assignee: Reliance Industries Limited, Mumbai (IN)

( * ) Notice: Subject to any disclaimer, the term of this patent is extended or adjusted under 35 U.S.C. 154(b) by 36 days.

(21) Appl. No.: 14/417,062

(22) PCT Filed: Jul. 10, 2013

(86) PCT No.: PCT/IN2013/000426
§ 371 (c)(1),
(2) Date: Jan. 23, 2015

(87) PCT Pub. No.: WO2014/033733
PCT Pub. Date: Mar. 6, 2014

(65) Prior Publication Data

US 2015/0210937 A1 Jul. 30, 2015

(30) Foreign Application Priority Data

Jul. 24, 2012 (IN) ..... 2116/MUM/2012

(51) Int. Cl.
*C10G 31/08* (2006.01)
*C10G 45/26* (2006.01)

(52) U.S. Cl.
CPC ..... *C10G 31/08* (2013.01); *C10G 45/26* (2013.01); *C10G 2300/202* (2013.01); *C10G 2300/4075* (2013.01)

(58) Field of Classification Search
CPC ..... C10G 31/08; C10G 45/26; C10G 2300/4075; C10G 2300/202
(Continued)

(56) References Cited

U.S. PATENT DOCUMENTS 3,547,806 A * 12/1970 Matyear ..... C07C 5/2789 208/262.1
3,864,243 A 2/1975 Reusser et al.
(Continued)

FOREIGN PATENT DOCUMENTS

GB 724266 A 2/1955
GB 1 105 287 A 3/1968
GB 1 122 716 A 8/1968

OTHER PUBLICATIONS

International Search Report issued in PCT/IN2013/000426 dated Feb. 13, 2014 (2 pages).

*Primary Examiner* — Prem C Singh
*Assistant Examiner* — Brandi M Doyle
(74) *Attorney, Agent, or Firm* — Osha Liang LLP

(57) ABSTRACT

A method for removing chloride impurities from a heavy hydrocarbon stream is disclosed. The heavy hydrocarbon stream is contacted with a stripping medium at a temperature ranging between 100-450° C. and at a pressure ranging between 0.1-2 bar with ratio of the heavy hydrocarbon stream to the stripping medium ranging between 1-30;
(Continued)

Figure 1:
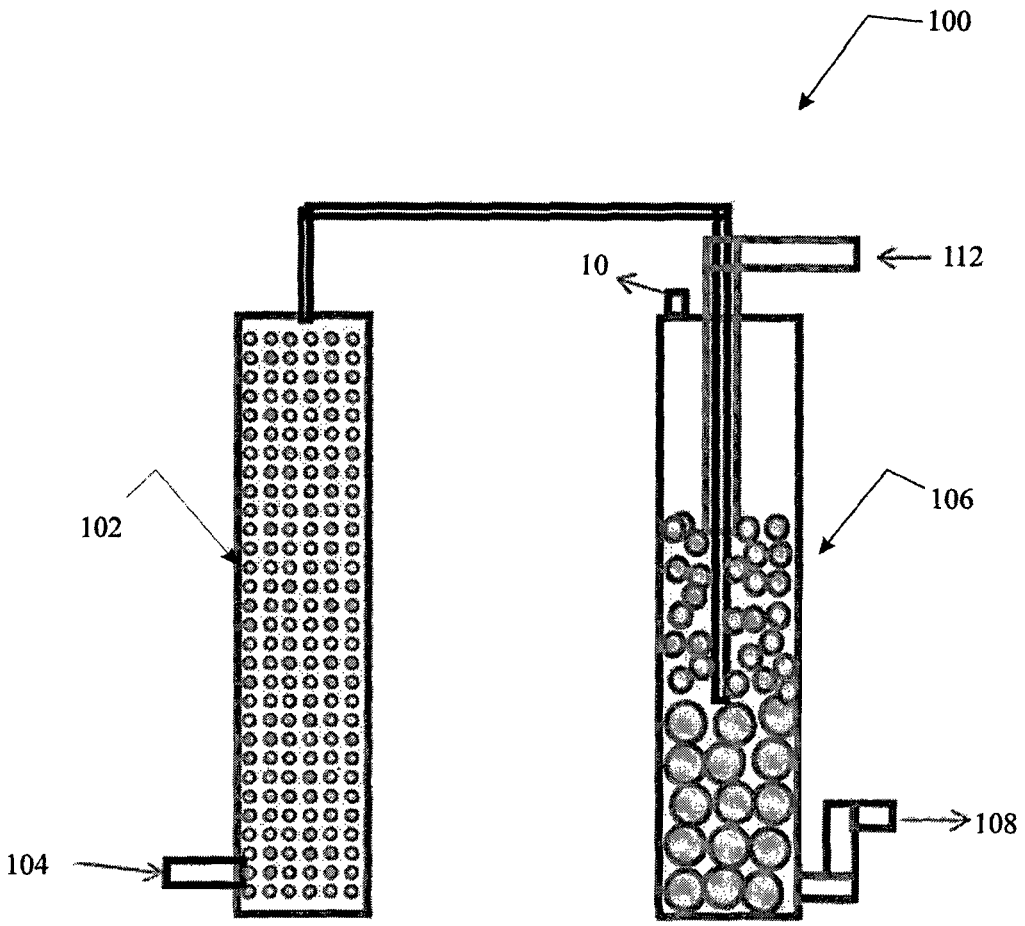

wherein the temperature is maintained below the initial boiling point of the hydrocarbon stream.

11 Claims, 2 Drawing Sheets

(58) Field of Classification Search
USPC ..... 208/262.1
See application file for complete search history.

(56) References Cited

U.S. PATENT DOCUMENTS

| | | | | |
|---|---|---|---|---|
| 3,892,818 | A | 7/1975 | Scharfe et al. | |
| 3,935,295 | A | 1/1976 | La Hue et al. | |
| 4,141,816 | A * | 2/1979 | Crowley | C10G 35/00 208/107 |
| 4,713,413 | A | 12/1987 | Tegge et al. | |
| 4,721,824 | A | 1/1988 | McWilliams et al. | |
| 4,992,210 | A | 2/1991 | Naeger et al. | |
| 5,107,061 | A | 4/1992 | Ou et al. | |
| 5,141,630 | A * | 8/1992 | Grosboll | B01D 3/343 203/49 |
| 5,269,908 | A * | 12/1993 | Krupay | C10G 7/10 203/7 |
| 5,371,313 | A | 12/1994 | Ostrowicki | |
| 5,387,733 | A | 2/1995 | Weaver | |
| 5,558,768 | A | 9/1996 | Ikura et al. | |
| 5,595,648 | A | 1/1997 | Yan | |
| 5,614,644 | A | 3/1997 | Liang et al. | |
| 5,645,713 | A | 7/1997 | Yan | |
| 6,060,033 | A | 5/2000 | Cheng | |
| 2003/0041508 | A1 * | 3/2003 | Handa | C08F 8/14 44/397 |
| 2004/0238405 | A1 | 12/2004 | Vercammen | |
| 2005/0075252 | A1 * | 4/2005 | Thomas, Jr. | C10M 135/10 508/390 |
| 2010/0206770 | A1 * | 8/2010 | Matsui | C10G 45/02 208/57 |
| 2011/0237853 | A1 | 9/2011 | Hamamatsu et al. | |
| 2012/0024750 | A1 * | 2/2012 | Zhan | C10G 29/205 208/56 |

* cited by examiner

METHOD FOR REMOVING CHLORIDES FROM HYDROCARBON STREAM BY STEAM STRIPPING

FIELD OF DISCLOSURE

The present disclosure relates to a method for removing chlorides from a hydrocarbon stream.

Particularly, the present disclosure relates to a method for removing chlorides from a heavy hydrocarbon stream such as naphtha, diesel, light vacuum gas oil, light coker gas oil, heavy atmospheric gas oil, heavy vacuum gas oil, heavy coker gas oil, vacuum gas oil or mixtures thereof.

BACKGROUND

Inorganic and organic chlorides present in even small quantities in hydrocarbon streams can upset the process conditions either by poisoning the catalyst or by causing corrosion of the equipment. For example: sever corrosion is observed in crude top column, hydrotreater reactor top and downstream circuit including surge drum, high temperature exchangers and transfer lines especially along the elbow/joint sections. Generally pitting type of corrosion is observed in these equipments, suggesting that chlorides are the main cause of corrosion. Among chlorides, hydrogen chloride and ammonium chloride have the highest potential to cause corrosion. In the hydrotreaters, the organic chlorides also get converted to inorganic chloride i.e. hydrogen chloride, therefore worsening the corrosion problem.

The hydrocarbon stream coming from crude distillation unit has significant amounts of inorganic and organic chlorides. For example: the gas oil produced in atmospheric distillation may contain up to 25 ppm chlorides while the light vacuum gas oil produced in the top section of vacuum distillation unit may contain up to 50 ppm chlorides. These chlorides are mainly produced by hydrolysis of chloride salts of magnesium and calcium metals. These metal salts are present in the crude oil and carried to the distillation unit due to insufficient desalting. Thus, both the inorganic and organic chlorides are detrimental to the hydrocarbon processing units, especially the hydrotreaters, and must be removed from the hydrocarbon stream prior to processing.

Commonly, an adsorbent or a catalyst is used to remove the chlorides from the hydrocarbon streams. U.S. Pat. No. 3,864,243 discloses use of bauxite as a chloride adsorbent, where the adsorbent is dehydrated at 425-650° C. before use. U.S. Pat. No. 3,935,295 discloses the use of calcium and zinc oxide adsorbent for removal of inorganic chlorides. U.S. Pat. No. 4,713,413 discloses the use of alumina adsorbent at 20° C. for removing organic chlorides. U.S. Pat. No. 5,107,061 discloses the use of crystalline molecular sieve Zeolite X in soda form for removal of organic chlorides from a hydrocarbon stream. U.S. Pat. No. 5,595,648 and U.S. Pat. No. 5,645,713 disclose the use of low surface area solid caustic bed for removing chlorides from hydrocarbon streams. U.S. Pat. No. 5,614,644 discloses the use of copper containing scavenger material for removing organic chlorides from hydrocarbon streams and U.S. Pat. No. 6,060,033 discloses, the use of alkali metal oxide loaded on alumina for removing inorganic chlorides from hydrocarbon streams.

Use of the afore-mentioned chloride adsorbents for removing chlorides from heavy hydrocarbon streams such as vacuum gas oil, or coker oil is unfeasible due to their high viscosities and high pour points and presence of small amounts of asphaltenic materials. These properties of the heavy hydrocarbon streams cause following problems when an adsorbent is used: high delta pressure is required across the adsorbent bed, higher temperature conditions are required for adsorption, difficulty in regeneration of the adsorbent, lower chloride loading capacity and lower chloride removal efficiency.

Also, catalysts have been used in the past for converting the organic chlorides to inorganic chlorides. U.S. Pat. No. 3,892,818 uses rhodium catalyst to convert pure organic chlorides to hydrogen chloride, where the catalyst contains 0.1 wt % rhodium and the reaction is carried out at about 250° C. U.S. Pat. No. 4,721,824 discloses the use of magnesium oxide and binder for catalytic removal of organic chlorides from hydrocarbon streams. U.S. Pat. No. 5,371,313 discloses the use of calcium oxide at 130-170° C. for removal of tert butyl chloride. The above-mentioned processes are suitable for light hydrocarbon streams ($<C_{20}$) and further treatment of the hydrocarbon stream is required to remove the inorganic chlorides produced thereof.

Some other known processes use additives to remove inorganic chlorides or reduce the corrosion impact. U.S. Pat. No. 5,269,908 discloses the addition of an inert gas such as steam, nitrogen, organic gases or natural gas, for reducing ammonium chloride deposition. U.S. Pat. No. 5,387,733 discloses the use of non-filming polyamine additive for inhibition and removal of ammonium chloride deposits in hydrocarbon processing units. U.S. Pat. No. 5,558,768 discloses the use of a non-ionic surfactant (copolymer of ethylene oxide and propylene oxide) for removal of chlorides from crude oil. The above-listed methods involve use of additive/catalyst and require a subsequent treatment for removal or deactivation of the additive/catalyst.

Further, some known processes use distillation or stripping, optionally in the presence of an additive, to remove impurities from hydrocarbon streams. A process for separating lighter components such as hydrogen, hydrogen sulfide, ammonia and hydrocarbons having less than 11 carbon atoms, from a heavier heating oil, by employing two stripping mediums is disclosed in U.S. Pat. No. 5,141,630. The first stripping medium removes/separates the lighter components and the second stripping medium removes or separates residue of the first stripping medium and any light components remaining in the feedstock. The stripping temperature is maintained between 200-750° F. (93-400° C.) and the stripping pressure is between 0-200 psig (0-14 bars). The first stripping medium is typically selected from hydrogen, methane, propane, steam or other inert gas, and the second stripping medium is typically nitrogen gas. According to the process disclosed in U.S. Pat. No. 5,141,630, steam is not a preferred stripping medium at the said process conditions since it saturates the stripped product with water and a subsequent drying step is necessary to remove the moisture. Also, this process is not suitable for removing chlorides from the heavy oil.

Another known process to remove chlorides is disclosed in US2004238405 which discusses converting the chlorides to volatile compounds by treatment of the oil stream with an additive and a stabilizer; volatile compounds can then be removed by stripping. This process is suitable for treating crude oil. Still another process is disclosed in U.S. Pat. No. 4,992,210 which comprises using an organic amine and potassium hydroxide in a water soluble solvent to desalt corrosive contaminants such as magnesium chloride, sodium chloride, calcium chloride and organic acids from crude oil. Yet another method is disclosed in GB1105287 and GB724266 which comprises preventing corrosion by using corrosion inhibitors. The method disclosed in GB1105287 involves preventing corrosion of metallic petroleum refining equipment by admixing a base such as sodium hydroxide or potassium hydroxide, to crude oil, to restrict the formation of corrosive hydrochloride and hydrogen sulfide. GB724266 discloses use of guanidine or a derivative of guanidine to reduce corrosion of the distillation apparatus during steam distillation of hydrocarbon oils.

All the above-listed known processes are used for treating light hydrocarbon fractions or crude oil. Heavy hydrocarbon streams are difficult to treat due to their high viscosity and pour point. The chloride removal from such streams is further difficult when concentration of the impurity is in the range of few ppm.

Still furthermore, all the presently known processes involve distillation which results in the removal of large amount of hydrocarbons while removing the chlorides. There is envisaged in accordance with the present disclosure a process for removal of chlorides that is based on stripping of the hydrocarbon and that involves minimum distillation.

OBJECTS

Some of the objects of the present disclosure are described herein below:

It is therefore an object of the present disclosure to provide a simple, effective and economical method for removing chlorides from heavy hydrocarbon streams such as naphtha, diesel, light vacuum gas oil, light coker gas oil, heavy atmospheric gas oil, heavy vacuum gas oil, heavy coker gas oil, vacuum gas oil or mixtures thereof.

Another object of the present disclosure is to provide a method for removing both inorganic and organic chloride impurities from heavy hydrocarbon streams without the use of an adsorbent, additive or catalyst.

Yet another object of the present disclosure is to provide a method for removing moisture from heavy hydrocarbon streams.

Other objects and advantages of the present disclosure will be more apparent from the following description when read in conjunction with the accompanying figures, which are not intended to limit the scope of the present disclosure.

SUMMARY

In accordance with the present disclosure, there is provided a method for removing chlorides from a heavy hydrocarbon stream, said method comprising the following steps:

- contacting the heavy hydrocarbon stream with a stripping medium at a temperature ranging between 100-450° C. and at a pressure ranging between 0.1-2 bar with ratio of the heavy hydrocarbon stream to the stripping medium ranging between 1-30, for stripping chlorides from the hydrocarbon stream, wherein the temperature is maintained below the initial boiling point of the hydrocarbon stream; and
- isolating a vapor stream containing, chlorides and light hydrocarbons from the heavy hydrocarbon stream.

Typically, the amount of chlorides present in the heavy hydrocarbon stream is in the range of 2-100 ppm.

In accordance with one of the embodiments, the heavy hydrocarbon stream contains moisture in the range of 100-2000 ppm.

In accordance with one embodiment, the stripping medium is steam and the metal chlorides are hydrolyzed to hydrogen chloride and the chlorides are stripped from the hydrocarbon stream in the form of hydrogen chloride.

In accordance with another embodiment, the stripping medium is at least one selected from the group consisting of nitrogen, air, argon and any other inert gas, which also removes moisture from the heavy hydrocarbon stream.

Typically, in accordance with the present disclosure, the heavy hydrocarbon stream is at least one hydrocarbon fraction selected from naphtha, diesel, light vacuum gas oil, heavy vacuum gas oil, light coker gas oil, heavy coker gas oil, heavy atmospheric gas oil and vacuum gas oil.

Preferably, in accordance with the present disclosure, the ratio of the heavy hydrocarbon stream to the stripping medium is in the range of 1-20.

Typically, in accordance with the present disclosure, the heavy hydrocarbon stream has an initial boiling point that ranges between 180-600° C.

In accordance with the present disclosure, the heavy hydrocarbon stream is contacted with the stripping medium in a stripping column selected from a packed column, a tray column and sieve column, where, flow of the heavy hydrocarbon stream with the stripping medium is selected from co-current and counter-current, and the method is operated in a manner selected from batch, semi-continuous and continuous.

Typically, in accordance with the present disclosure, the method further comprises heating the heavy hydrocarbon stream to the stripping temperature by exchanging heat with at least one stream selected from stripping column bottom stream, steam and an auxiliary heating medium.

Preferably, in accordance with the present disclosure, the method further comprises condensing the vapor stream and recovering the light hydrocarbons from the condensed stream for further chloride removal.

BRIEF DESCRIPTION OF THE ACCOMPANYING DRAWINGS

Figure 2:
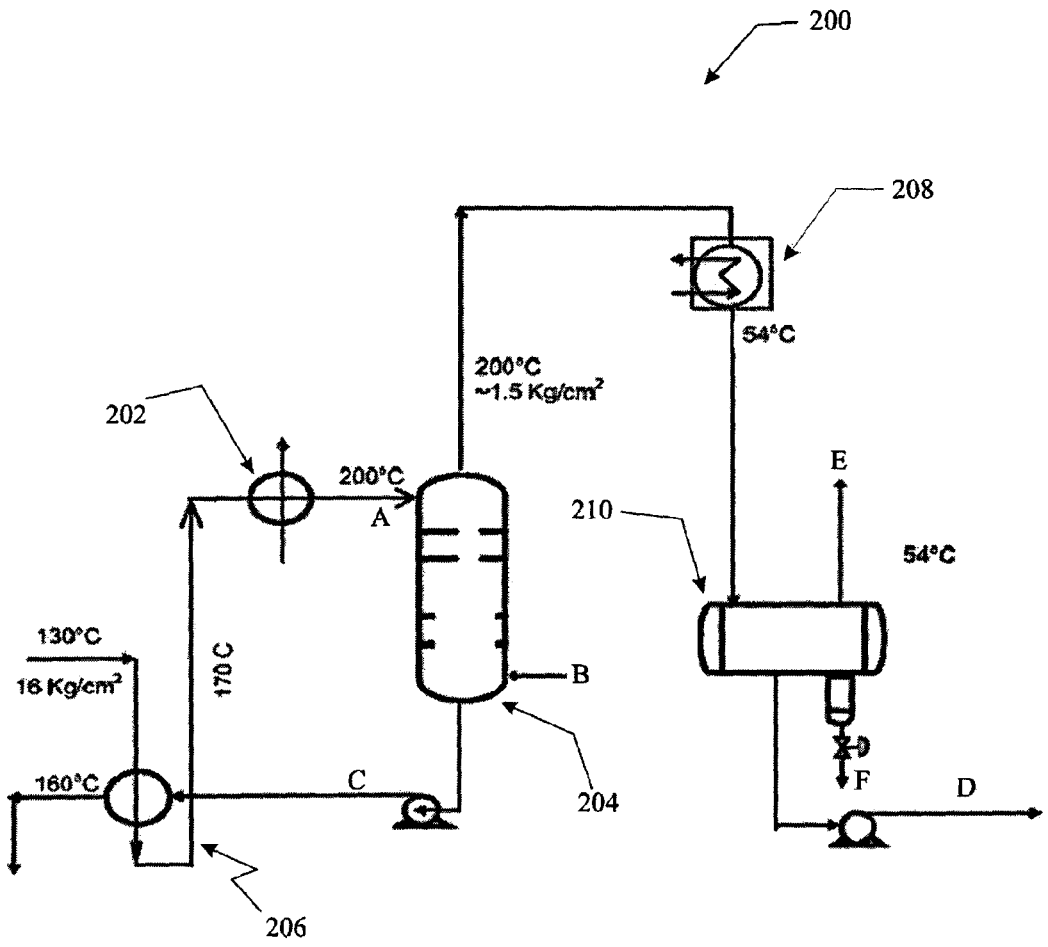

The disclosure will now be described with the help of the accompanying drawings, in which, FIG. 1 illustrates the arrangement for steam stripping of hydrocarbon stream in accordance with the present disclosure; and FIG. 2 illustrates a schematic of the process configuration for treatment of light vacuum gas oil in accordance with the present disclosure.

DETAIL DESCRIPTION OF THE DRAWINGS

Referring to FIG. 1, there is disclosed an exemplary embodiment 100 of the present disclosure for steam stripping of the heavy hydrocarbon stream. In the exemplary embodiment 100, a steam generator 102 is provided in operative communication with a stripping column 106. The steam generator 102 comprises a water inlet 104 for receiving water at a flow rate of about 2 mL/min. The water is converted to steam having a temperature of about 300° C. The steam at 300° C. is received in the stripping column 106 in a counter-current flow pattern with the heavy hydrocarbon stream which enters at inlet 112. The stripping column temperature is maintained at 200° C. The exemplary stripping column 106 has a height of 100 cm and a diameter of 2.5 cm. The stripping column 106 is packed with 6 mm ceramic balls up to the height of 40 cm from the bottom-up. From 40-80 cm the stripping column 106 is packed with 5 mm high surface area packing material. The contacting of the heavy hydrocarbon stream with the steam mostly happens in the 40-80 cm zone with high surface area material. The purified hydrocarbon stream is collected from the bottom at outlet 108 and the used stripping agent (steam) is vented into the atmosphere from steam outlet 110 provided at the top of the stripping column 106.

Referring to FIG. 2, there is disclosed a schematic of the process configuration for treatment of light vacuum gas oil in accordance with the present disclosure. The various heavy hydrocarbons streams and hydrocarbon residues can be treated similarly with modifications in the process conditions based on the boiling range of the hydrocarbon stream. In accordance with the exemplary embodiment, the process primarily comprises heating the LVGO up to the stripping temperature, first by exchanging heat with purified LVGO leaving at the bottom of the stripping column via line C (the path of the hydrocarbon stream is marked by numeral 206), and then by using high pressure steam or any auxiliary heating medium at 202. The process is carried out in a packed or tray column 204 having adequate theoretical stages, in a counter-flow pattern; where the stripping medium enters via line B and flows upwards. The hydrocarbon stream having a temperature of 200° C. enters via line A and flows downwards in the column 204. The vapor stream carrying the light LVGO are removed from the top section and carried to a condenser 208 for condensation. The condensed stream is treated in a receiver 210 to separate the non-condensable gases through line E, chloride containing water through line F, and light LVGO through line D. The non-condensable gases are used in a flare. The light LVGO containing some amounts of chlorides are sent to a crude desalter for further removal of the chlorides. The purified hydrocarbon stream is collected from the bottom section of the column and carried through line C. The treated product contains 1-10 ppm chlorides and can be passed to a hydrotreater without the requirement for any catalyst deactivation or corrosion inhibition. This process can be carried out continuously in the same stripping column without the need for regeneration, reactivation or cleaning of the packings/trays. The process can be further carried out by using other stripping medium like nitrogen or air or argon or any other inert gas to obtain simultaneous moisture reduction. The process can also be carried out by flowing the hydrocarbon stream and the stripping medium in a co-current pattern.

DETAILED DESCRIPTION

A heavy hydrocarbon stream such as naphtha, diesel, light vacuum gas oil, light coker gas oil, heavy atmospheric gas oil, heavy vacuum gas oil, heavy coker gas oil, vacuum gas oil, or mixtures thereof, having chlorides in the range of 2-100 ppm, can be treated in accordance with the method of the present disclosure.

The chloride salts are left in the hydrocarbon streams in small amounts even after the de-salting process. A majority of the salts are inorganic salts of alkali and alkali earth metals, namely, sodium chloride, calcium chloride and magnesium chloride. In the crude distillation unit (CDU), the desalted crude is heated to about 370° C. to fractionate the different products. During this process, hydrolysable salts, particularly magnesium and calcium salts, get hydrolyzed in the presence of steam and are released as hydrogen chloride from the top of the distillation unit. The remaining unhydrolyzed salts are carried from the CDU to the vacuum distillation unit (VDU) where these salts are further hydrolyzed and released in the form of hydrogen chloride. However, a portion of the hydrogen chloride vapors is reabsorbed by the residual moisture present in the hydrocarbon stream. The reabsorption is favored when the hydrocarbon stream is at a lower temperature, i.e. between 45-130° C. The concentration of chlorides in such hydrocarbon streams leaving the vacuum distillation units is between 1-0.100 ppm.

As shown in table-1, water washing of hydrocarbon removes more than 70%, of chlorides but the moisture content increases significantly.

TABLE 1

Effect of water washing on chloride and moisture

| Sr. No. | Volume of LVGO, mL | Volume of D M Water, mL | Temp, ° C. | Moisture, wt % | LVGO Cl, ppm | Chloride reduction, % |
|---|---|---|---|---|---|---|
| 1 | 100 | 0 | NA | 0.0175 | 4.6 | — |
| 2 | 100 | 15 | 140 | 0.35 | 1.0 | 78.3 |
| 3 | 100 | 30 | 140 | — | 0.7 | 84.8 |

This data suggests that more than 70% of the total chlorides present in these heavy hydrocarbon streams are water soluble inorganic chlorides and the left-over are water insoluble organic chlorides. The moisture is typically present as a stable fine emulsion. The distribution of inorganic chlorides into hydrogen chloride and metal chlorides was estimated by metals analysis of wash water as shown in Table 2.

TABLE 2

Metal distribution in the wash water

| Crude Distillation unit | Metal in ppm | | | | | | | | | Total Metal, ppm |
|---|---|---|---|---|---|---|---|---|---|---|
| | Fe | Ni | V | Na | Al | Ca | K | Mg | Zn | |
| Unit 1 | 0.55 | 0.01 | 0.02 | 1.00 | 0.05 | 0.14 | 0.08 | 0.01 | 0.01 | 1.96 |
| Unit 2 | 0.25 | 0.02 | 0.02 | 0.47 | 0.04 | 0.30 | .011 | 0.02 | 0.20 | 1.43 |
| Unit 2 | 0.20 | 0.01 | 0.02 | 0.20 | 0.03 | 0.13 | 0.08 | 0.01 | 0.06 | 0.74 |

As seen from Table-2; if all the metals are present as their respective chloride salt, then also metal chlorides alone can account for no more than 2 ppm of the total 10-20 ppm chloride present in LVGO. This suggests that majority of water soluble inorganic chlorides is present as hydrogen chloride and only 10-20% are present as metal chlorides.

The method of the present disclosure involves removing the chloride impurities from such heavy hydrocarbon streams by stripping the heavy hydrocarbon stream with a stripping medium at strictly controlled temperature which is below the Initial Boiling Point (IBP) of the heavy hydrocarbon stream and pressure ranging between 0.1 to 3 bar The heavy hydrocarbon stream, such as naphtha, diesel, light vacuum gas oil, light coker gas oil; heavy atmospheric gas oil, heavy vacuum gas oil, heavy coker gas oil, vacuum gas oil, or mixtures thereof, having an initial boiling point ranging between 180-600° C. and is contacted with a stripping medium selected from low pressure steam, medium pressure steam, high pressure steam or nitrogen or air or argon or any other inert gas, in a stripping column in a co-current or counter-current flow, at a temperature ranging between 100-450° C. and at a pressure ranging between 0.1-2 bar, with ratio of the heavy hydrocarbon stream to the stripping medium ranging between 1-30, preferably between 1-20.

In accordance with one embodiment of the present disclosure; steam is used as the stripping medium. Steam hydrolyzes the metal chlorides to hydrogen chloride and thus the chlorides are stripped in the form of hydrogen chloride. During the stripping process, some of the metal chlorides ($MgCl_2$, $CaCl_2$, etc.) in the hydrocarbon stream are hydrolyzed to hydrogen chloride and thereafter the hydrogen chloride is stripped from the hydrocarbon stream. The purified heavy hydrocarbon stream so obtained contains up to 70% less chlorides.

In accordance with another embodiment of the present disclosure an inert gas selected from the group consisting of nitrogen, air, argon and any other inert gas is used as the stripping medium. The heavy hydrocarbon feed comprising moisture ranging between 100-2000 ppm is contacted with the stripping medium. When the inert gas or air is used as the stripping medium apart from the chlorides it also removes moisture from the heavy hydrocarbon stream. The heavy hydrocarbon stream contains hydrogen chloride gas in dissolved state. When the gaseous stripping medium is passed through this hydrocarbon stream the solubility of dissolved hydrogen chloride is reduced hence, it comes out of the solution and gets carried away with the gaseous stripping medium.

The stripping column is a packed column, tray column, a sieve column or any other contacting column having high stripping efficiency, which provides a batch, semi-continuous or continuous process. The stripping temperature is maintained below the initial boiling point of the hydrocarbon stream.

In the process, less than 1 wt % of light hydrocarbons from the heavy hydrocarbon stream are separated as a vapor stream. The vapor stream is condensed and the light hydrocarbons are recovered there from for further chloride removal.

The temperature and pressure are critical parameters in the stripping process, in which, maximum chloride removal is attained with minimum or no distillation of the hydrocarbon feed. The distillation of hydrocarbon stream is not desired in the process since it generates a light hydrocarbon fraction having more chlorides than the primary hydrocarbon stream and therefore the distilled fraction is more corrosive than the primary feed. The process of the present disclosure minimizes the distillation of the hydrocarbon feed by accurate control of the temperature and pressure during stripping.

The heavy hydrocarbon stream can be heated to the stripping temperature, prior to receiving the stream in the stripping column, by means of stripping column bottom stream, steam or an auxiliary heating medium.

The disclosure will now be described with to the help of examples which do not limit the scope and ambit of the disclosure.

Example 1

The apparatus disclosed in FIG. 1 was used in the following experimental study. Distilled water at a flow rate of 2 mL/min was pumped into the steam generator to generate steam at 300° C. The steam produced was introduced into the stripping column at a height of 40 cm from the bottom of stripping column. The column is maintained at 200° C. Light vacuum gas oil (LVGO) having a chloride content of 12 ppm and moisture content of 588 ppm was passed into the stripping column at 80 cm from the bottom of the column. The flow of the LVGO was kept at 10 mL/min and the LVGO and steam ratio was maintained at 4.5 (w/w). The stripping was carried out at atmospheric pressure. The used stripping steam was vented from the top of the stripping column and the stripped hydrocarbon stream was collected from the bottom of the stripping column. The chloride content in the stripped LVGO product was 3.7 ppm showing a reduction of 69%. The moisture content of the stripped LVGO product was 710 ppm showing an increase of 20.7%.

Example 2

The apparatus disclosed in FIG. 1 was used in the following experimental study. All the process conditions were similar to those in Example 1, except that the flow rate of the LVGO was increased to 30 mL/min such that the LVGO to the steam ratio (w/w) of 13.5 was attained. The chloride content in the stripped LVGO product was 6.8 ppm showing a reduction of 43%. The moisture content of the stripped LVGO product was 690 ppm showing an increase of 17.3%.

Example 3

For this study, all the process conditions were kept similar to those in Example 1, except that nitrogen was used as the stripping medium. The chloride content of the stripped LVGO product was 8.5 ppm showing a reduction of 27.6% and the moisture level was 461 ppm showing a decrease of 21.5%.

The results from Examples 1-3 are tabulated in Table 3.

TABLE 3

Change in chloride concentration for Examples 1-3.

| Example No. | Stripping agent | Feed flow, mL/min | Stripping agent flow, g/min | Stripping temp.,° C. | Hydrocarbon to stripping agent ratio | % reduction in Cl | % Change in moisture |
|---|---|---|---|---|---|---|---|
| 1 | Steam | 10 | 2 | 200 | 4.5 | 69 | 20.7 |
| 2 | Steam | 30 | 2 | 200 | 13.5 | 43 | 17.3 |
| 3 | Nitrogen | 10 | 2 | 200 | 4.5 | 27.6 | −21.5* |

*Negative sign denotes reduction in moisture after stripping.

From Examples 1-3, it was observed that steam provides higher stripping efficiency over nitrogen. Also, the feed flow rate and the hydrocarbon to the stripping agent ratio affect the stripping efficiency. Better chloride removal is obtained with higher contact time between the hydrocarbon stream and the stripping agent.

Technical Advantages

A method for removing chlorides from a heavy hydrocarbon stream, as described in the present disclosure has several technical advantages including but not limited to the realization of:

- it is a simple, effective and economical method for removing chlorides from heavy hydrocarbon streams such as naphtha, diesel, light vacuum gas oil, light coker gas oil, heavy atmospheric gas oil, heavy vacuum gas oil, heavy coker gas oil, vacuum gas oil or mixtures thereof;
- the method removes inorganic chloride impurities from the heavy hydrocarbon streams without the use of any adsorbent, additive or catalyst; and
- the method also removes residual moisture from the heavy hydrocarbon streams.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the invention to achieve one or more of the desired objects or results.

Any discussion of documents, acts, materials, devices; articles or the like that has been included in this specification is solely for the purpose of providing a context for the invention. It is not to be taken as an admission that any or all of these matters form part of the prior art base or were common general knowledge in the field relevant to the invention as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the invention, unless there is a statement in the specification specific to the contrary.

In view of the wide variety of embodiments to which the principles of the present invention can be applied, it should be understood that the illustrated embodiments are exemplary only. While considerable emphasis has been placed herein on the particular features of this invention, it will be appreciated that various modifications can be made, and that many changes can be made in the preferred embodiments without departing from the principle of the invention. These and other modifications in the nature of the invention or the preferred embodiments will be apparent to those skilled in the art from the disclosure herein, whereby it is to be distinctly understood that, the foregoing descriptive matter is to be interpreted merely as illustrative of the invention and not as a limitation.

The invention claimed is:

1. A method for removing chlorides from a heavy hydrocarbon stream comprising chlorides in the range of 2 ppm and 100 ppm, said method comprising the following steps:

(i) contacting the heavy hydrocarbon stream with steam as a stripping medium at a temperature between 100 and 450° C. and at a pressure between 0.1 and 2 bar with ratio of the heavy hydrocarbon stream to the stripping medium between 1 and 30, for stripping chlorides from the hydrocarbon stream, wherein the temperature of the heavy hydrocarbon stream during contact is maintained below the initial boiling point of the heavy hydrocarbon stream; and (ii) isolating a vapor stream containing chlorides and light hydrocarbons from the stripped heavy hydrocarbon stream obtained in step (i) to obtain a purified heavy hydrocarbon stream containing chlorides reduced by an amount in the range of 43% to 70% and light hydrocarbons reduced by an amount not more than 1 wt %.

2. The method as claimed in claim 1, wherein the heavy hydrocarbon stream contains moisture in the range of 100 and 2000 ppm.

3. The method as claimed in claim 1, wherein the chlorides are hydrolyzed to hydrogen chloride before being stripped from the hydrocarbon stream.

4. The method as claimed in claim 1, wherein the heavy hydrocarbon stream is at least one hydrocarbon fraction selected from naphtha, diesel, light vacuum gas oil, heavy vacuum gas oil, light coker gas oil, heavy coker gas oil, heavy atmospheric gas oil and vacuum gas oil.

5. The method as claimed in claim 1, wherein the ratio of the heavy hydrocarbon stream to the stripping medium is in the range of 1 and 20.

6. The method as claimed in claim 1, wherein the heavy hydrocarbon stream has an initial boiling point between 180 and 600° C.

7. The method as claimed in claim 1, wherein the heavy hydrocarbon stream has an initial boiling point between 300 and 500° C.

8. The method as claimed in claim 1, wherein the heavy hydrocarbon stream is contacted with the stripping medium in a stripping column selected from a packed column, a tray column and sieve column.

9. The method as claimed in claim 1, wherein the heavy hydrocarbon stream is contacted with the stripping medium in the stripping column, where flow of the heavy hydrocarbon stream with the stripping medium is selected from co-current and counter-current.

10. The method as claimed in claim 1, further comprising heating the heavy hydrocarbon stream to the stripping temperature by exchanging heat with at least one stream selected from stripping column bottom stream, steam and an auxiliary heating medium.

11. The method as claimed in claim 1, further comprising condensing the vapor stream and recovering the light hydrocarbons from the condensed stream for further chloride removal.

* * * * *